US010486048B2

(12) United States Patent
Gravel

(10) Patent No.: US 10,486,048 B2
(45) Date of Patent: Nov. 26, 2019

(54) NET SHIELD FOR ROLLER ACCESSORIES FOR A SPORTS GOAL

(71) Applicant: James H. Gravel, The Villages, FL (US)

(72) Inventor: James H. Gravel, The Villages, FL (US)

( * ) Notice: Subject to any disclaimer, the term of this patent is extended or adjusted under 35 U.S.C. 154(b) by 175 days.

(21) Appl. No.: 15/682,586

(22) Filed: Aug. 22, 2017

(65) Prior Publication Data

US 2018/0078840 A1 Mar. 22, 2018

Related U.S. Application Data

(63) Continuation-in-part of application No. 14/795,047, filed on Jul. 9, 2015, now Pat. No. 9,889,365.

(60) Provisional application No. 62/377,751, filed on Aug. 22, 2016.

(51) Int. Cl.

| | |
|---|---|
| ***A63B 71/00*** | (2006.01) |
| ***A63B 63/00*** | (2006.01) |
| ***A63B 71/02*** | (2006.01) |

(52) U.S. Cl.

CPC ..... *A63B 71/0036* (2013.01); *A63B 63/004* (2013.01); *A63B 71/0054* (2013.01); *A63B 2071/025* (2013.01); *A63B 2071/026* (2013.01)

(58) Field of Classification Search

CPC ..... A63B 71/0036; A63B 63/004; A63B 2071/026; A63B 2071/025

See application file for complete search history.

(56) References Cited

U.S. PATENT DOCUMENTS

| | | | | |
|---|---|---|---|---|
| 4,389,047 A * | 6/1983 | Hall | A63B 21/0054 482/2 |
| 8,905,872 B2 * | 12/2014 | Ennis | A63B 63/004 473/478 |
| 2014/0169922 A1 * | 6/2014 | Cozza | B62B 3/0625 414/495 |

* cited by examiner

*Primary Examiner* — Jeffrey S Vanderveen

(74) *Attorney, Agent, or Firm* — John M Brandt

(57) ABSTRACT

A net shield apparatus for preventing contact and entanglement between the net of a sports goal and a roller component of a rolling ballast system mounted on the rear of the goal in the form of a cover which overlaps the roller and includes an arrangement to secure the net on the outer surface of the shield.

7 Claims, 7 Drawing Sheets

NET SHIELD FOR ROLLER ACCESSORIES FOR A SPORTS GOAL

CROSS REFERENCE TO RELATED APPLICATIONS

This application is based on the disclosure of U.S. provisional patent application 62/377,751 by the same inventor filed Aug. 22, 2016 which is hereby incorporated by reference, and is a continuation-in-part of U.S. utility patent application Ser. No. 14/795,047 by the same inventor filed Jul. 9, 2015.

BACKGROUND OF THE INVENTION

Field of the Invention

The invention resides in field of sports goals and more particularly relates to goals for outdoor use having a framework for supporting a net and further to devices pertaining to preventing such goals from tipping over or shifting position due to high wind, player impact, or inappropriate use by unauthorized use by others.

Description of the Prior Art

More specifically the invention is directed to goals having rollers or drums that are rotatably connected to and axially aligned with the rear ground bar of a sports goal, for example, a soccer goal to provide a rolling ballast system that both prevents accidental soccer goal tip over and offers the portability necessary to move the goals from one location to another. These drums may either be rotatably mounted directly on the rear cross bar as disclosed in applicant's U.S. Pat. No. 8,579,736 or parallel and adjacent thereto as shown in applicants pending U.S. application Ser. No. 14/795,047.

During the movement of soccer goals using these rollers, the goal nets, which are frequently loose and hang over the rollers, may be caught between the rollers and contiguous goal structural members restricting the movement of the goal and reducing the effectiveness of the ballast system. As described herein, adding a net shield of the invention around, atop, or over the roller where it can prevent contact between the net and the roller as well as capture the net and remove the net slack with, for example, straps or tie wraps, offers an improved design over the prior art and greatly improves the performance of a rear roller ballast system.

SUMMARY OF THE INVENTION

The invention may be summarized as a net shield which is used in conjunction with a rear mounted roller system connected at the back of a sports goal, for example, a soccer goal. The shield comprises a rigid cover which is adapted to be positioned between the outer cylindrical surface of the roller and the rear most portion of the net adjacent the ground bar of the goal. Net attachment means, for example straps, are used to secure the lower rear portion of the net over the back of the shield.

DESCRIPTION OF THE PREFERRED EMBODIMENT

Figure 1:
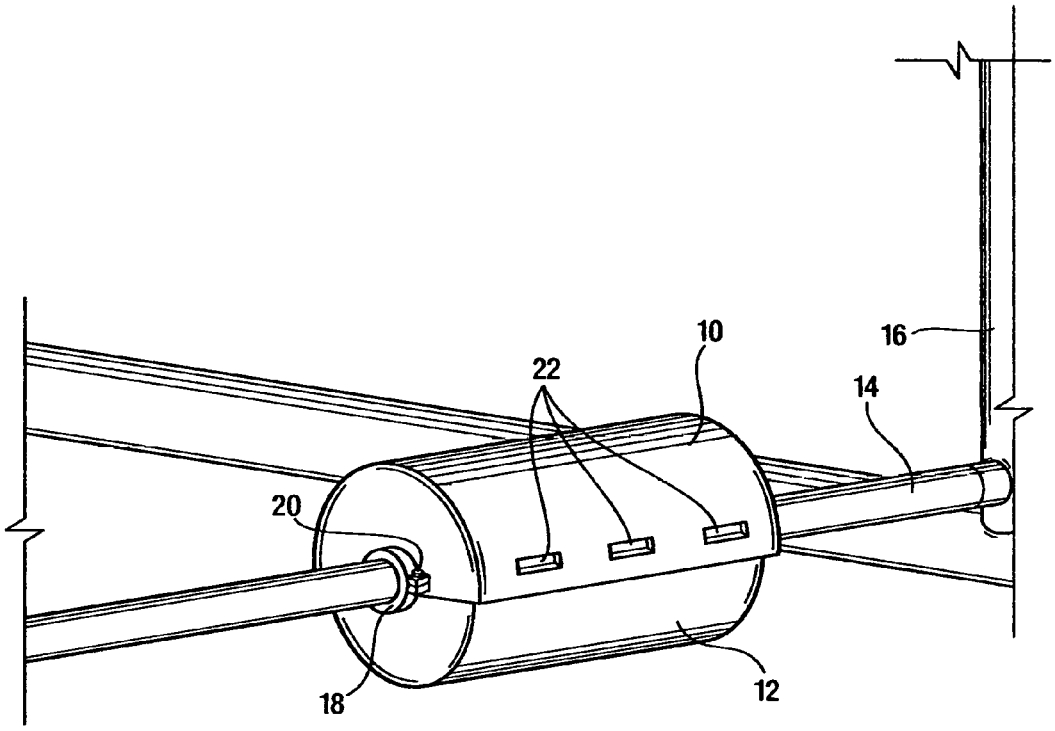
FIG. 1 is a perspective view of a first preferred embodiment of the shield invention.
Figure 2:
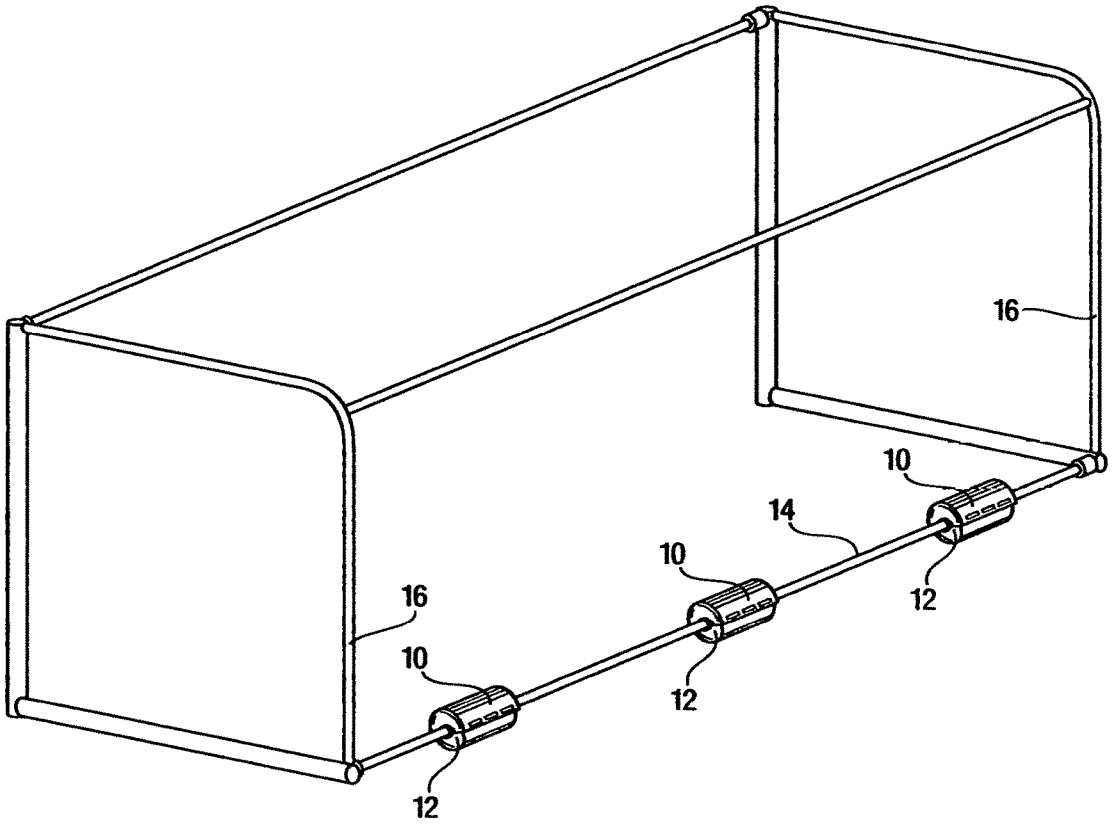
FIG. 2 is an additional perspective view of the first preferred embodiment of the invention of FIG. 1.
Figure 3:
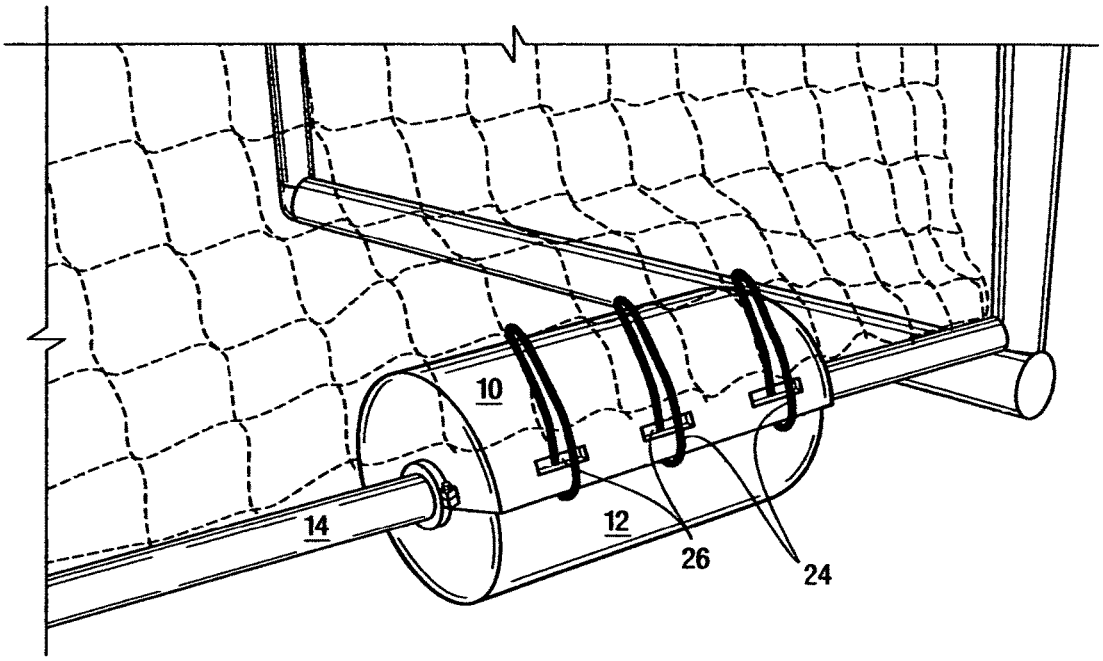
FIG. 3 is a further perspective view of the first preferred embodiment of the invention of FIG. 1.

FIGS. 1, 2, and 3 show a first embodiment of the invention wherein a net shield 10, preferably comprising a cover of a conforming shape and closely fitted to a ballast roller, is disposed over such a roller 12 mounted on a crossbar 14 positioned at the rear of a goal between the two sides 16 as is illustrated in the above referenced U.S. Pat. No. 8,579,536.

The shield is held in place in relation to the roller and the crossbar by, for example. Collar 18 secured to the crossbar by set-screw 20. Other means to secure the positioning of the shield to cover the top of the roller, to prevent the net from falling under the roller as the goal is moved from place to place for field maintenance or storage, may be used depending on the particular structure of the existing goal and roller configuration.

As shown in FIG. 2, a plurality of rollers and shields of the invention may be placed along the crossbar.

Slots or ports 22 are disposed in the rear side of the shield to provide a means for attaching the net to the shield using, for example, straps 24 as illustrated in FIG. 3. Other devices such as hooks, eyelets, or double apertures 26 may be employed for the same purpose.

Figure 4:
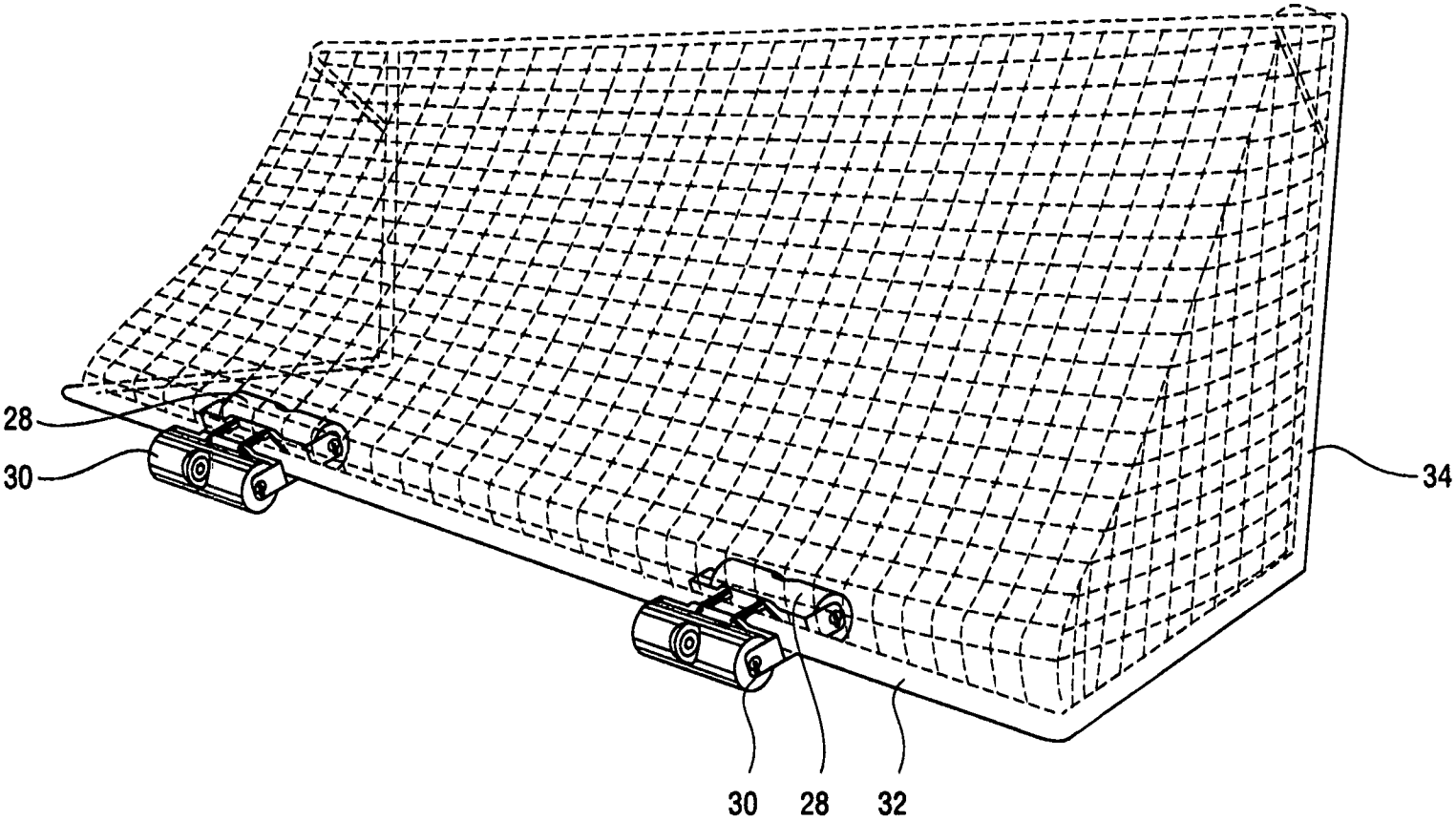
FIG. 4 is a perspective partial view of a goal mounted on a roller assembly appropriate for a second preferred embodiment of the invention.

A second embodiment of the invention is depicted in FIGS. 4-7 showing the use of a net shield installed on a roller in which the axis of rotation is parallel to the crossbar but does not coincide with it. Referring to FIG. 4, a perspective view of an apparatus suitable for use with the second preferred embodiment is illustrated in which front hollow roller 28 and rear hollow roller 30 are mounted on a goal rear crossbar 32. This is an example of an apparatus designed for providing weight and facilitating mobility to the rear of a goal as is disclosed and fully described in U.S. published application Ser. No. 14/795,047 showing a pair of rollers, one on each side of the rear cross bar as a structural member of goal frame 34. Rollers 28 and 30 are rotationally mounted on roller support frame 36 which is secured to bar 32 by, for example clamping members 36.

Figure 5:
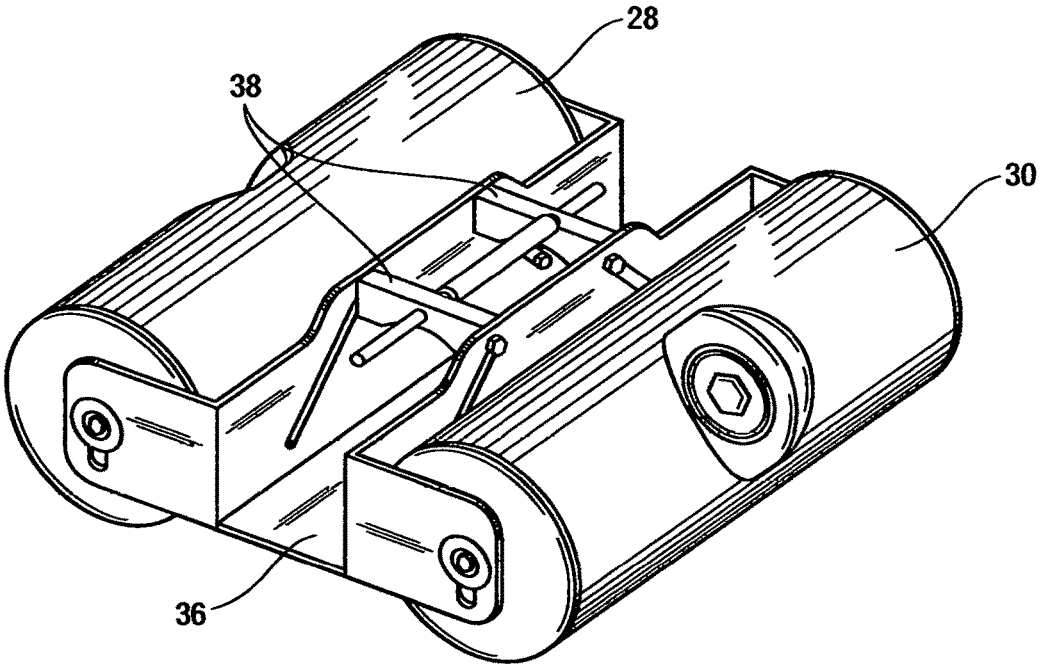
FIG. 5 is a detailed perspective view of the roller assembly of FIG. 4.

This roller assembly as is shown in more detail in FIG. 5, is symmetrical allowing for a reverse or 180 degree rotation in positioning the apparatus on the rear ground crossbar 32.

Figure 6:
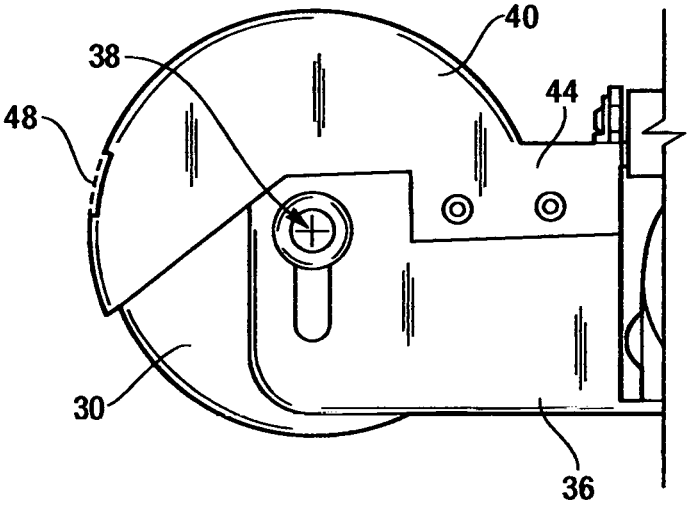
FIG. 6 is an elevation view of a portion of the roller assembly of FIG. 5 showing the installation of the second preferred embodiment of the invention.

FIG. 6 illustrates one of such rollers, rotatable about axis 38 with a net shield 40 installed behind the position of the rear crossbar.

Figure 7:
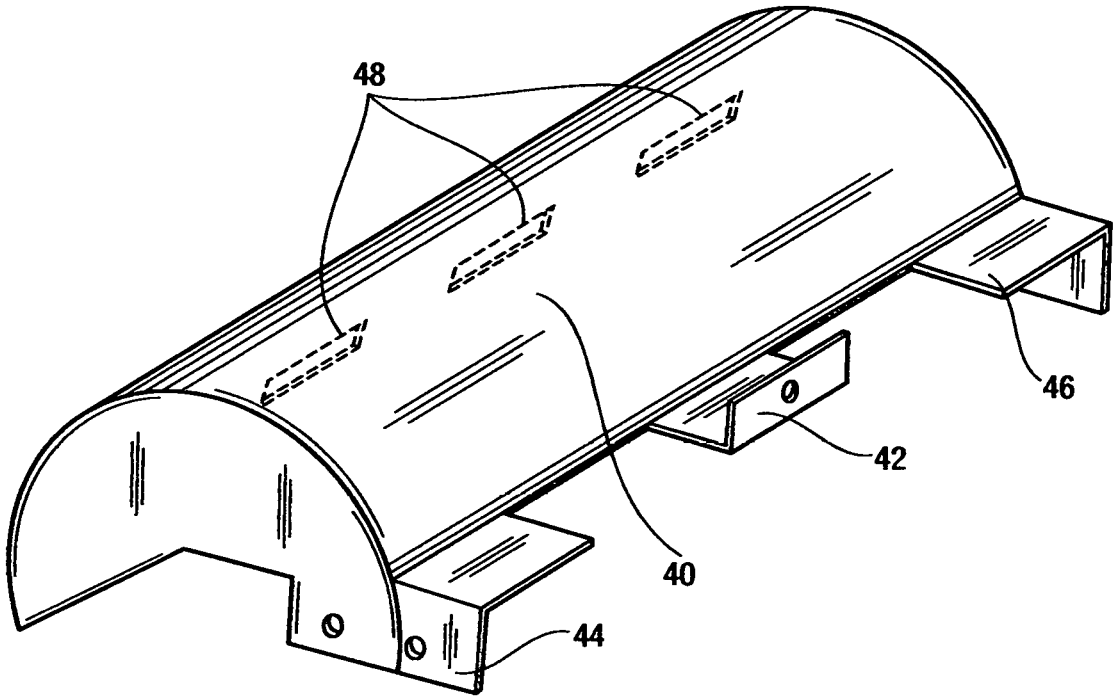
FIG. 7 is a perspective view of the second preferred embodiment of the invention.

FIG. 7 is a perspective view of the net shield 40 of FIG. 6 dismounted from the roller unit discussed above. Center flange 42 and side flanges 44 and 46 are used to attach the shield to support frame 36. Means for securing a goal net over the top of the shield are similar to those of FIG. 3 of the first embodiment and may comprise, for example, ports 48 through which a strap may be passed to capture the lower end of the net.

What is claimed is:

1. In a sports goal for capturing a game piece on a playing field, said goal comprises a framework of linear structural members in a rectangular configuration including a rear ground crossbar and a net disposed over said framework, and at least one roller having an outer surface rotatably connected to and axially aligned with said rear crossbar for moving said goal, shield apparatus for preventing contact between said roller and said net comprising in combination:

A. a shield having an outer surface disposed over and above said outer surface of said roller; and B. a connector assembly disposed between said shield and said net to secure said net over said outer surface of said shield for separating said net and said roller thereby preventing entanglement of said net and said roller when said goal is transported on said roller from one location to another.

2. The shield apparatus of claim 1 wherein said roller is rotatably mounted on said crossbar.

3. The shield apparatus of claim 2 wherein said shield comprises a portion of a cylinder positioned coaxially over and above said outer surface of said roller.

4. The shield apparatus of claim 3 wherein said connector assembly comprises at least one port longitudinally disposed along said outer surface of said shield and further includes at least one tie passed through said port engaging said net.

5. A weighted roller apparatus for a ground disposed sports goal, said goal comprising a net supporting frame having at least two spaced apart side members joined at the rear by a ground crossbar and at the front by a top crossbar, said roller apparatus comprising in combination:

A. a framework attachable to said ground crossbar, said ground crossbar having a longitudinal axis;

B. a first weighted roller having a longitudinal axis, said first weighted roller rotatably attached to said framework forward of and adjacent to said ground crossbar, the longitudinal axis of said first weighted roller arranged to be parallel to that of said ground crossbar;

C. a second weighted roller having an outer surface and a longitudinal axis, said second weighted roller rotatably attached to said framework rearward of and adjacent to said ground crossbar, the longitudinal axis of said second weighted roller arranged to be parallel to that of said ground crossbar and said first weighted roller, the diameters of said first and second weighted rollers of sufficient size to raise said ground crossbar above said ground; and D. shield apparatus for preventing contact between said second weighted roller and said net comprising in combination:

1. a shield having an outer surface disposed over and above said outer surface of said second weighted roller; and 2. a connector assembly disposed between said shield and said net to secure said net over said outer surface of said shield for separating said net and said second roller thereby preventing entanglement of said net and said second weighted roller when said goal is transported on said roller apparatus from one location to another.

6. The shield apparatus of claim 5 wherein said shield comprises a portion of a cylinder positioned coaxially over and above said outer surface of said second roller.

7. The shield apparatus of claim 6 wherein said connector assembly comprises at least one port longitudinally disposed along said outer surface of said shield and further includes at least one tie passed through said port for engaging said net.

* * * * *